US006756946B1

(12) United States Patent
Deng et al.

(10) Patent No.: US 6,756,946 B1
(45) Date of Patent: Jun. 29, 2004

(54) MULTI-LOOP ANTENNA

(75) Inventors: Sheng Ming Deng, Hsinchu (TW); Horng-Wei Tseug, Tainan (TW)

(73) Assignee: Inpaq Technology Co., Ltd., Hsinchu (TW)

( * ) Notice: Subject to any disclaimer, the term of this patent is extended or adjusted under 35 U.S.C. 154(b) by 0 days.

(21) Appl. No.: 10/422,853

(22) Filed: Apr. 25, 2003

(51) Int. Cl.[7] ..... H01Q 11/12
(52) U.S. Cl. ..... 343/742; 343/702; 343/867
(58) Field of Search ..... 343/700 MS, 702, 343/741, 742, 866, 867, 728, 870, 893

(56) References Cited

U.S. PATENT DOCUMENTS 5,557,293 A * 9/1996 McCoy et al. ..... 343/867
6,052,091 A * 4/2000 Lee ..... 343/742
6,300,914 B1 * 10/2001 Yang ..... 343/741
6,542,126 B2 * 4/2003 Bahr et al. ..... 343/702
6,693,594 B2 * 2/2004 Pankinaho et al. .. 343/700 MS

* cited by examiner

*Primary Examiner*—Shih-Chao Chen
(74) *Attorney, Agent, or Firm*—Troxell Law Office PLLC

(57) ABSTRACT

A multi-loop antenna includes two or more than two antennas units with different lengths, receiving signals with different frequencies respectively; and several slices of conductors, with different lengths, making the connections between above-mentioned antennas units. As different connections between the antennas are made, different connection modules are formed. Thus the antenna gets to receive signals of multiband frequency and/or broadband frequency.

4 Claims, 9 Drawing Sheets

MULTI-LOOP ANTENNA

BACKGROUND OF THE INVENTION

1. Field of the Invention

The present invention relates to a multi-loop antenna, especially to the antenna with two or more slices of conductors that connect with two or more antenna units that receiving signals of different frequencies, and thus achieving good capacity in receiving multiband frequency and/or broadband frequency.

2. Description of the Prior Art

The structure of an internal antenna in a mobile phone in prior art shown in FIGS. 1A and 1B. On top of the FIG. 1A is the antenna substrate 200, and the grounding substrate 100 is beneath the antenna substrate 200. The aforementioned substrates are connected by a component 300. In general, as shown in FIG. 1B, the distance between the antenna substrate 200 and the grounding substrate 100 is extended in order to increase the bandwidth of the frequency. The longer the distance "d" is, the lower the equivalent value Q is, meanwhile, the frequency bandwidth of the signals is increased.

However, the thickness of a conventional mobile phone is limited, so the distance between the antenna substrate and the grounding substrate is restricted. Therefore, an idea of multi-loop structure of antenna circuit is invented to produce diverse combinations in neighboring antenna units in order to receive multi frequency. By the means of the multi-loop design, the antenna may receive frequency with multiband resonance.

A present structure of a conventional antenna is shown in FIGS. 2A and 2B. It is clearly shown that the present structure, which is on the antenna substrate 200, comprising two antenna units 4*a* and 4*b*. Wherein, a longband antenna 4*a* is located in the outside of the antenna substrate 200 and connects to the grounding end, and a shortband antenna 4*b* is located in the inside of the antenna substrate 200, connecting the feeding end. There is a conductor 4*c* mounted between the longband 4*a* and the shortband 4*a*. A current 900 may enter the feeding end, passing through shortband 4*a*, connecting conductor 4*c* and longband 4*b*, and then to the grounding end. Thus a complete circuit is formed.

In this type of sliced antenna in mobile phones, the position and the amount of the conductors 4*c* is fixed. Therefore, it can just form only one circuit and receive dual-band frequency.

Moreover, as the circuit of this type of antenna is fixed, the received dual frequency is also fixed. As a result, the frequency ratio cannot be tuned.

SUMMARY OF THE INVENTION

Accordingly, it is an object of the present invention to provide a multi-loop antenna, which increases the frequency bandwidth by means of the antenna units receiving different frequencies and being connected together. It is another object of the present invention to enable the adjustment of the proportion of the wideband/multiband frequencies by means of the antenna units connected by two or more conductors, wherein the antenna units, which receive different ranges of signals. According to the multi-loop antenna of the present invention, by means of two or more connecting conductors, different modules of connections may be accomplished, and the ability and flexibility of receiving wideband signals may also be achieved, and thus the frequency ratio and the flexibility of signal receiving are increased. It is a further object of the present invention.

The present invention will be better understood and its numerous objects and advantages will become apparent to those skilled in the art by referencing to the following drawings in which:

DETAILED DESCRIPTION OF THE PREFERRED EMBODIMENTS

FIGS. 1A to 2B are the schematic drawings showing the embodiments of circuit of a conventional sliced antenna. The functions and defects of the conventional embodiments have been described above.

Figure 1A:
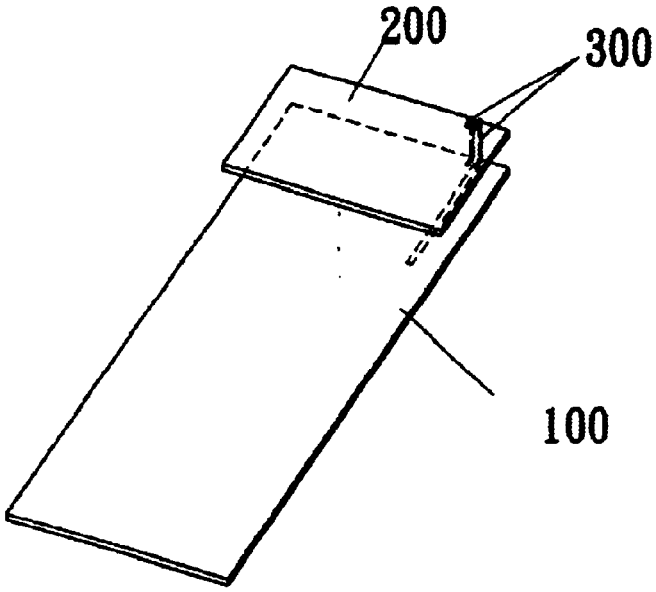
FIG. 1A (PRIOR ART)
FIGS. 1A and 1B are perspective views of the embodiment showing a conventional hidden antenna in a mobile phone.
Figure 1B:
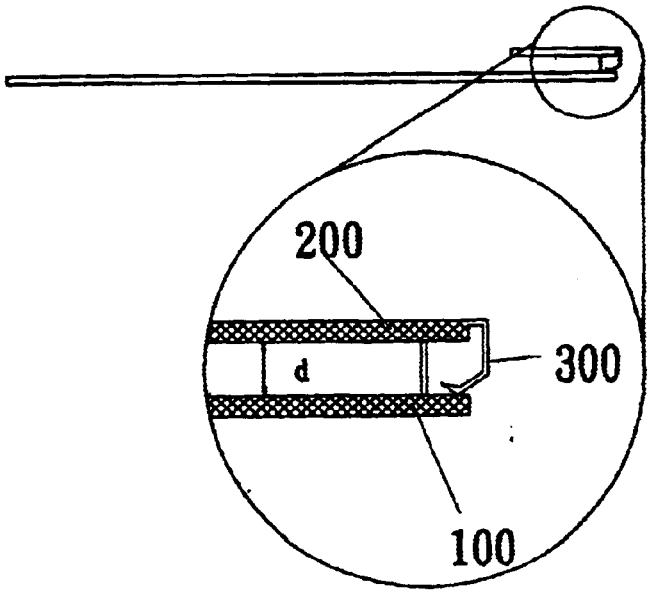
FIG. 1B (PRIOR ART)
Figure 2B:
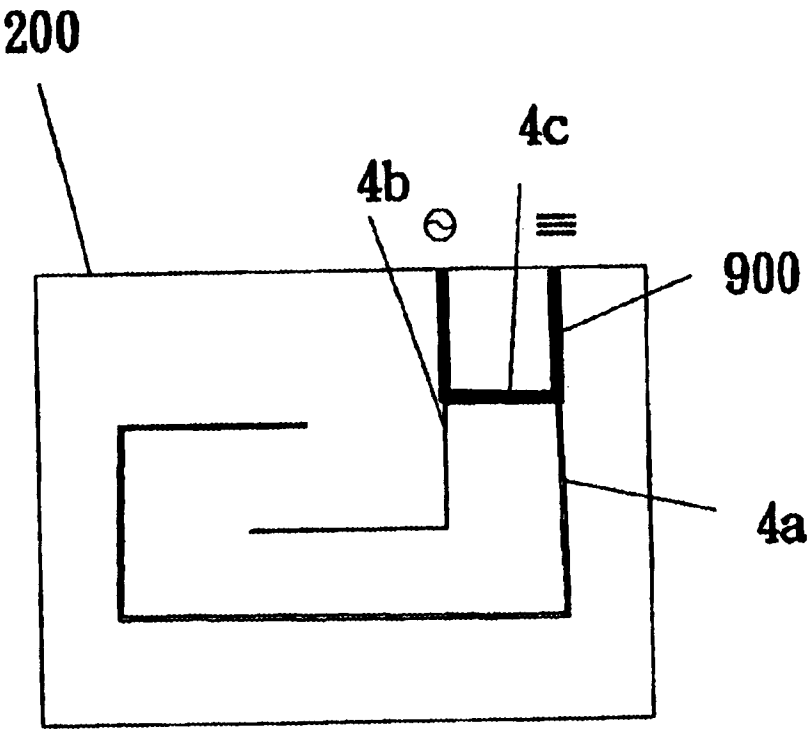
FIG. 2B (PRIOR ART)
FIG. 2B is a perspective view of the embodiment showing the current circuit of a conventional sliced antenna in a mobile phone.
Figure 2A:
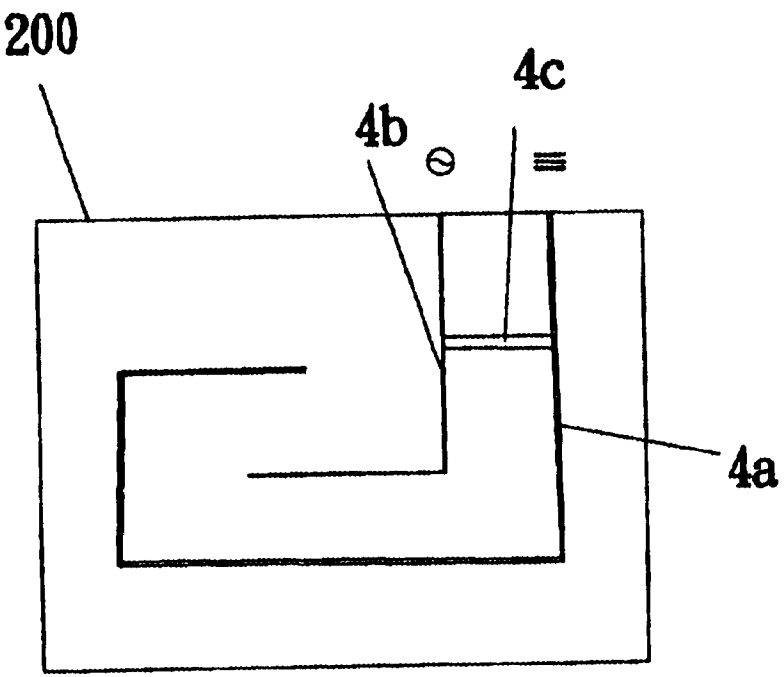
FIG. 2A (PRIOR ART)
FIG. 2A is a perspective view of the embodiment showing the circuit structure of a conventional sliced antenna in a mobile phone.
Figure 3C:
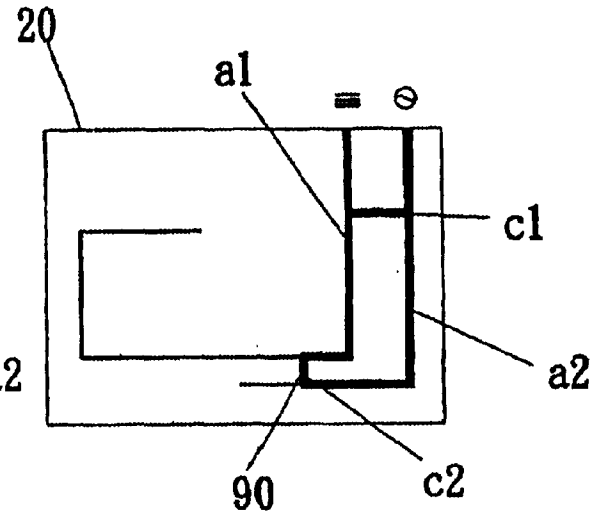
FIGS. 3A and 3B are perspective views showing the current circuit of a multi-loop antenna of the present invention.
Figure 3B:
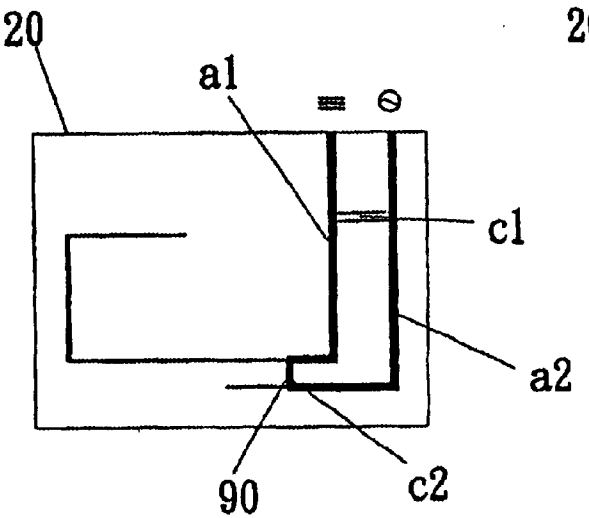
Figure 3A:
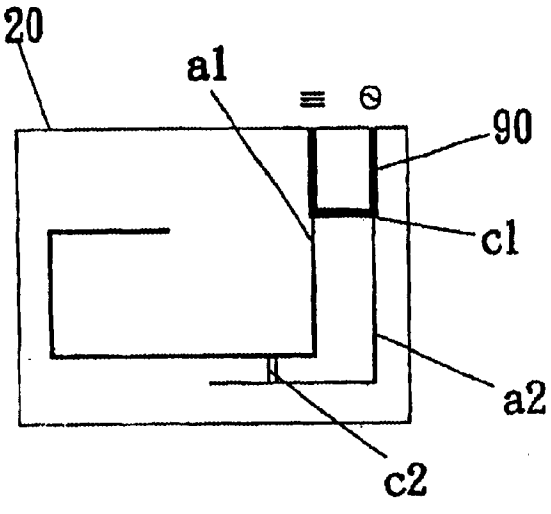

FIGS. 3A and 3B are schematic drawings showing the circuit according to the multi-loop antenna of the present invention. The multi-loop antenna of the present invention consists of two or more of antenna units a1 and a2, wherein the antenna unit a1 is connected to the grounding end; the other antenna unit a2 is connected to the feeding end. The antenna unit a1 may receive a specific frequency of signal, and the antenna unit a2 receives another specific frequency. There are also two or more conductors c1 and c2 which mount between the antenna units a1 and a2. According to the structure mentioned above, the circuit a1-c1-a2 receives a specific range of frequency, and the circuit a1-c2-a2, of which the equivalent length is different to the a1-c1-c2 circuit, receives another specific range of frequency, as shown in FIGS. 3B and 3C. Because the frequencies received by the antenna units a1 and a2 are different, as they are connected together by the conductors c1 and c2, it may form two or more modules and may receive multiband and/or wideband frequency signals, and the bandwidth of the antenna is increased.

Figure 4:
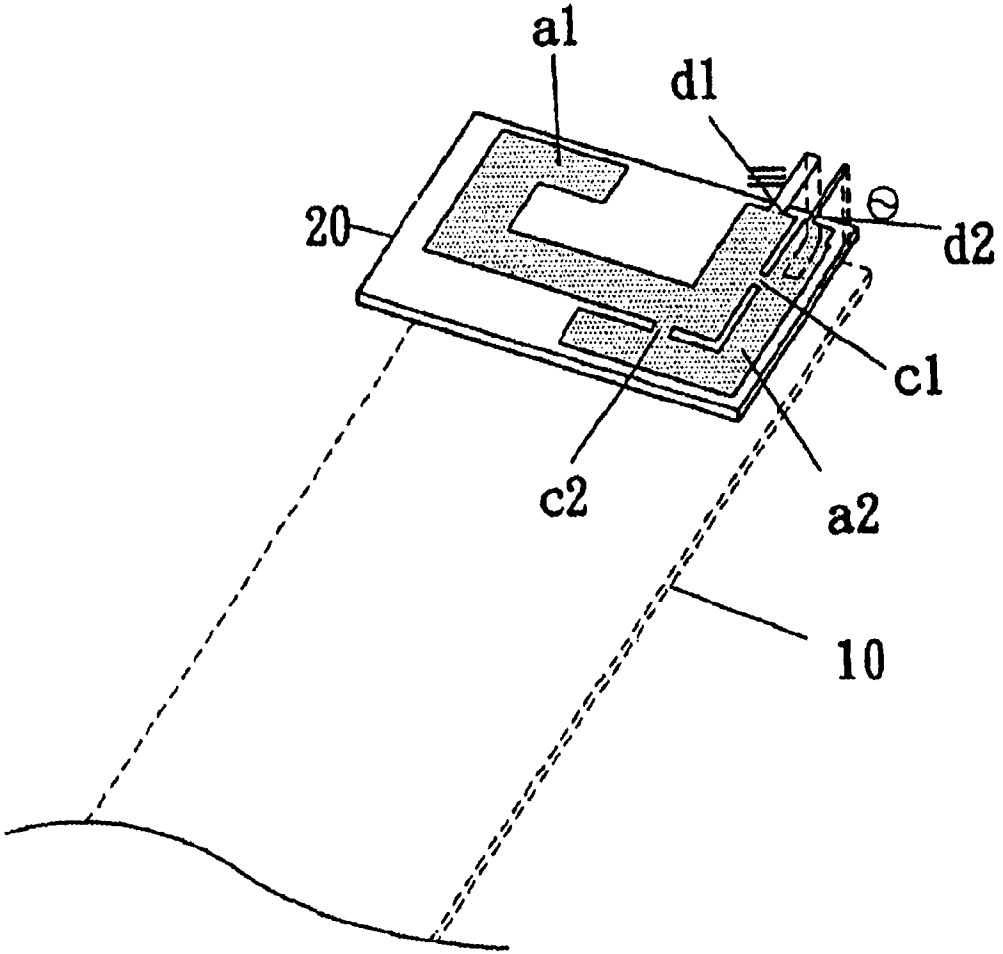
FIG. 4 is a perspective view of the preferred embodiment showing the multi-loop antenna of the present invention.

Referring now to FIG. 4 it will be observed from the drawing that the preferred embodiment of the multi-loop antenna of the present invention. The antenna unit (longband) a1 is located at the center of the antenna substrate 20, which is surrounded by the antenna unit (shortband) a2; these two antenna units a1, a2 are apart from each other for a specific distance and are linked with two or more conductors c1 and c2.

From FIG. 4, there is a grounding end d1 protruding from the antenna unit (longband) a1, and a feeding end d2 protruding from the antenna unit (shortband) a2. Wherein, the materials of the grounding end d1 and the feeding end d2 are made of the same material as the antenna unit (longband) a1 and the antenna unit (shortband) a2. The feeding end and the grounding end are also formed in one piece with the antenna and are connected with the grounding substrate 10. According to the structure mentioned above, a multi-loop antenna of the present invention is formed.

EXAMPLE 1

Figure 5A:
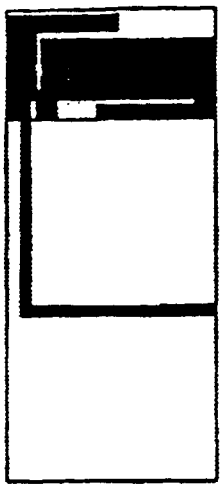
FIG. 5A is a plane view showing the construction of a single-loop antenna.

Please refer to FIG. 5A, it shows an example of construction of single-loop antenna.

Figure 5B:
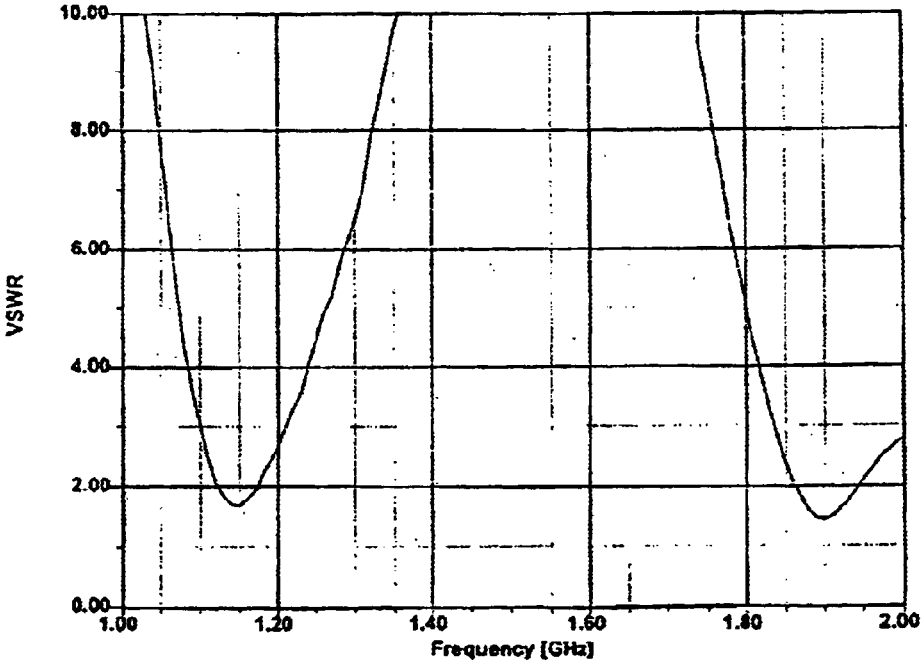
FIG. 5B is a diagram showing the VSWR values of the antenna in FIG. 5A corresponding to different frequencies.

From the diagram of FIG. 5B, it is clearly shown that when the VSWR is not greater than 2, the central frequency of low frequency is about 1.15 GHz with the band width of 50 MHz; the central frequency of high frequency is about 1.9 GHz with 80 MHz bandwidth, respectively.

EXAMPLE 2

Figure 6A:
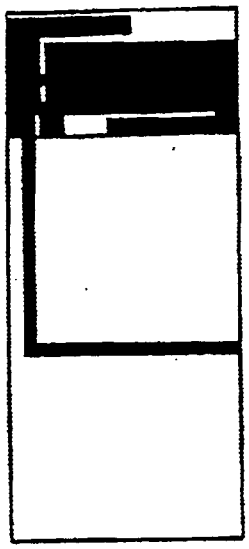
FIG. 6A is a plane view showing the construction of a two-loops antenna.

Please refer to FIG. 6A, is shows an example of construction of two-loops antenna.

Figure 6B:
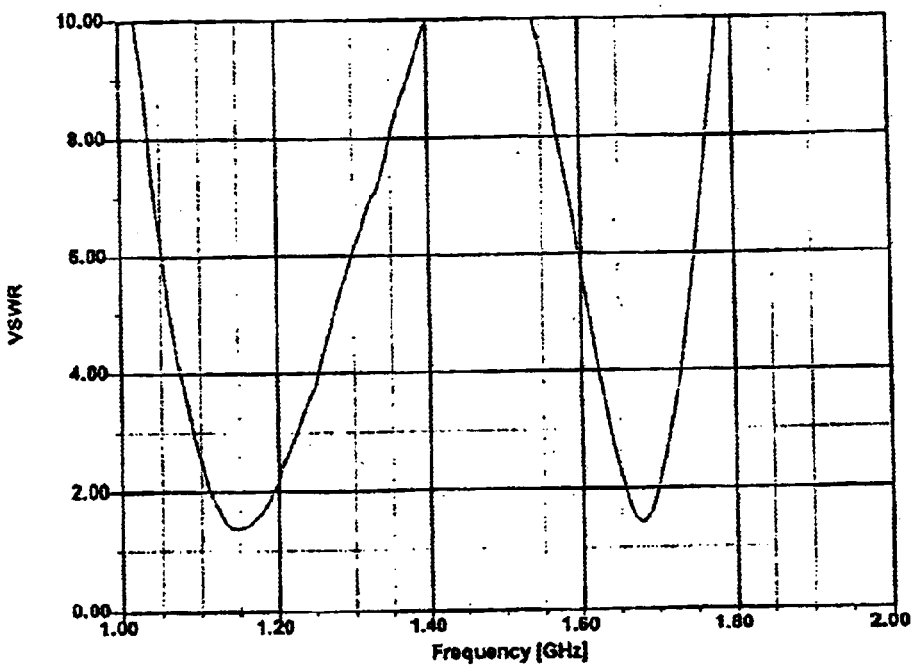
FIG. 6B is a diagram showing the VSWR values of the antenna in FIG. 6A corresponding to different frequencies.

From the diagram of FIG. 6B, it is clearly shown that when the VSWR is not greater than 2, the central frequency of low frequency is about 1.15 GHz with the band width of 80 MHz, the central frequency of high frequency is about 1.67 GHz with 50 MHz bandwidth, respectively.

EXAMPLE 3

Figure 7A:
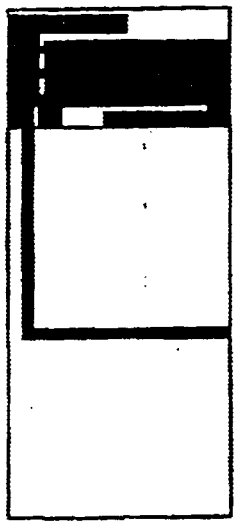
FIG. 7A is a plane view showing the construction of a three-loops antenna.

Please refer to FIG. 7A, is shows an example of construction of three-loops antenna.

Figure 7B:
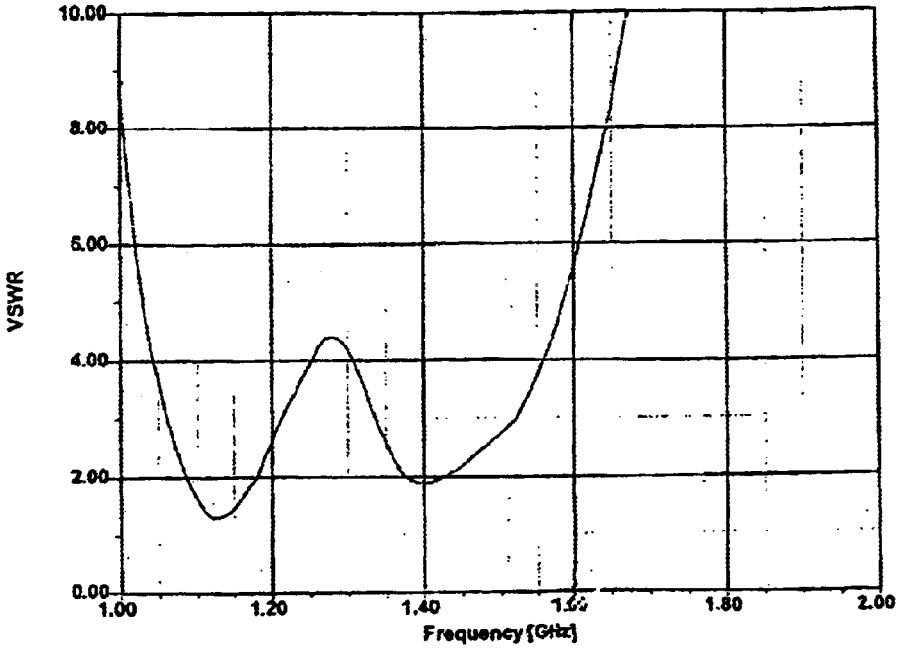
FIG. 7B is a diagram showing the VSWR values of the antenna in FIG. 7A corresponding to different frequencies.

From the diagram of FIG. 7B, it is clearly shown that when the VSWR is not greater than 2, the central frequency of low frequency is about 1.13 GHz with the band width of 80 MHz, the central frequency of high frequency is about 1.4 GHz with 50 MHz bandwidth, respectively.

EXAMPLE 4

Figure 8A:
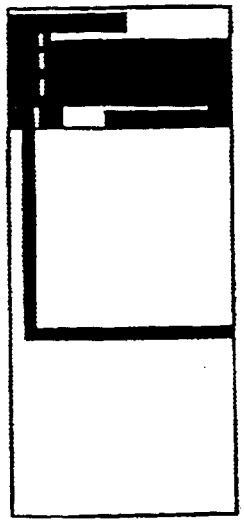
FIG. 8A is a plane view showing the construction of a four-loops antenna.

As shown in FIG. 8A, it shows an example of four-loops antenna.

Figure 8B:
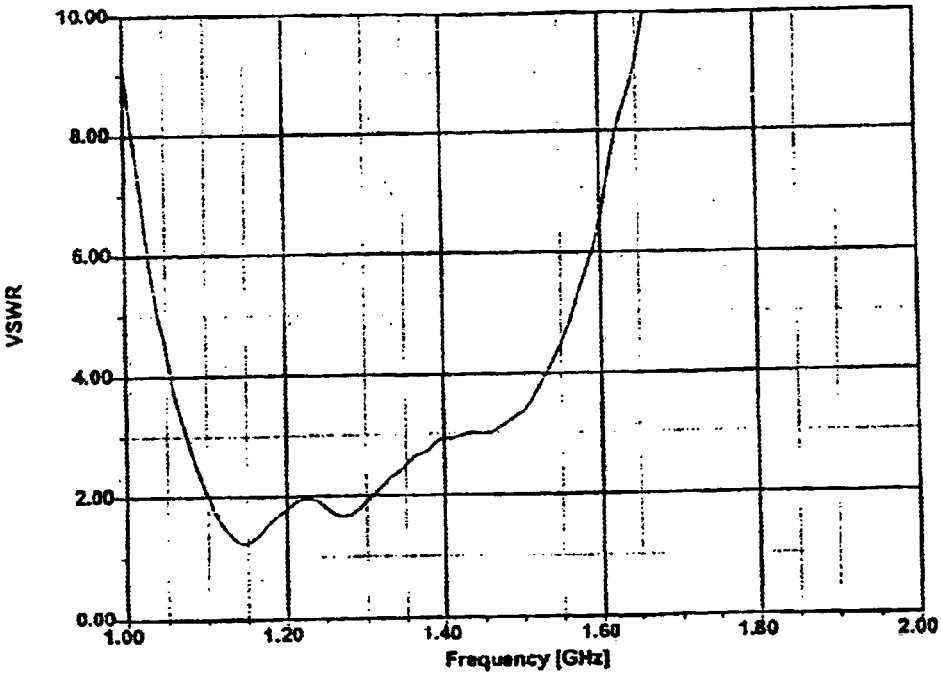
FIG. 8B is a diagram showing the VSWR values of the antenna in FIG. 8A corresponding to different frequencies.
Figure 9A:
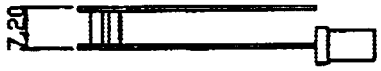
FIGS. 9A, 9B and 9C are the top view, the plane view, and the side view of an antenna of the FIG. 8A having practical dimensions.
Figure 9B:
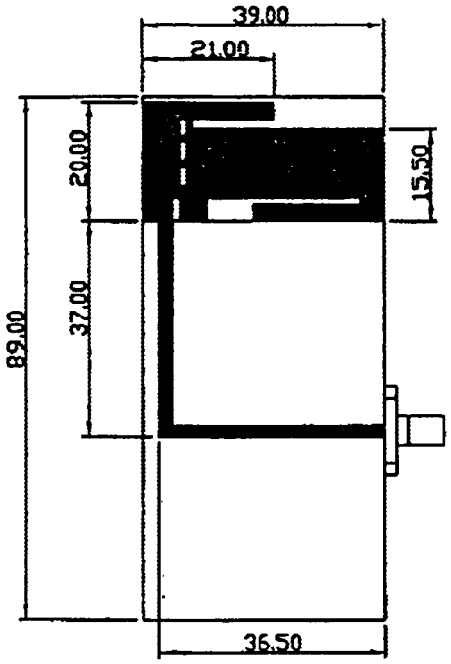
Figure 9C:
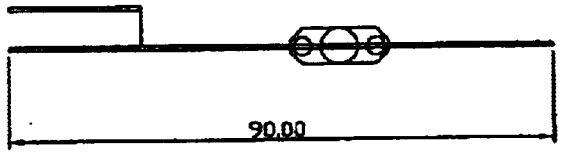

From the diagram of FIG. 8B, it is clearly shown that its low frequency is about 1.2 GHz with a bandwidth of 210 MHz, while its dimensions of practical uses can be seen from FIGS. 9A, 9B and 9C.

It is known from the above description that the structure of the multi-loop antenna of the present invention enables the antenna to receive signals with two groups or above modules. Thus the variability and the flexibility while receiving signals are improved, and the bandwidth of receiving frequency is broadened.

While the present invention has been described herein with reference to particular embodiments thereof, latitude of modification, various changes and substitutions are intended in the foregoing disclosure. And in some instances, some features of the invention will be employed without a corresponding use of other features without departing from the spirit of the invention as set forth herein.

What is claimed is:

1. A multi-loop antenna comprising:

a) at least two spaced apart metal antenna units having different lengths and receiving diverse signals with different frequencies; and b) at least two spaced apart conductors, each conductor of the at least two spaced apart conductors being connected to middle sections of two adjacent metal antenna units of the at least two adjacent antenna units to form different connecting modules.

2. The multi-loop antenna according to claim 1, wherein each of the at least two spaced apart conductors includes at least one strip of metal.

3. The multi-loop antenna according to claim 1, wherein each of the at least two spaced apart metal antenna units includes a terminal protruding from one end thereof, the terminal being connected to a grounding substrate.

4. The multi-loop antenna according to claim 3, wherein the terminal and the antenna unit of each of the at least two spaced apart metal antenna units are integrally made.

* * * * *